US005365640A

United States Patent [19]

Sterin

[11] Patent Number: 5,365,640

[45] Date of Patent: Nov. 22, 1994

[54] APPARATUS FOR SORTING FIBERS

[76] Inventor: Shlomo Sterin, Rechov Barzani 305/16, Jerusalem, 92811, Israel

[21] Appl. No.: 26,581

[22] Filed: Mar. 5, 1993

[30] Foreign Application Priority Data

Mar. 6, 1992 [IL] Israel ..... 101168

[51] Int. Cl.[5] ..... D01B 3/00

[52] U.S. Cl. ..... 19/200; 209/142

[58] Field of Search ..... 19/200, 202, 203, 204, 19/205, 106 R, 150, 296; 57/408, 410, 411, 412, 413; 209/142, 143, 145, 154

[56] References Cited

U.S. PATENT DOCUMENTS

| | | | |
|---|---|---|---|
| 3,341,008 | 9/1967 | Mayer, Jr. et al. | 19/200 |
| 4,471,607 | 9/1984 | Sohmolke . | |
| 4,631,781 | 12/1986 | Shofner | 19/200 |
| 4,809,404 | 3/1989 | Lasenga | 19/106 R |
| 4,827,574 | 5/1989 | Nakano et al. | 19/200 |
| 5,031,280 | 7/1991 | Demuth . | |
| 5,111,551 | 5/1992 | Hollingsworth et al. . | |
| 5,241,726 | 9/1993 | Pezzoli et al. | 19/200 |

FOREIGN PATENT DOCUMENTS

| | | | |
|---|---|---|---|
| 247463 | 10/1963 | Australia | 19/200 |

*Primary Examiner*—Clifford D. Crowder

*Assistant Examiner*—Michael A. Neas

*Attorney, Agent, or Firm*—Browdy and Neimark

[57] ABSTRACT

An apparatus for sorting fibers and separating them into fractions with desirable and undesirable properties comprises a housing provided with a first chamber; a device for introducing fibers to be sorted into the first chamber; a rotary element revolvably supported in the first chamber and provided with a mechanism for receiving the fibers and applying a fast rotary movement thereto; a multiplicity of material-receiving channels leading from the first chamber, a first one of which is provided with a first window adjacent to the rotary element for the reception of trash of relatively greater mass than the remaining material, a second one of which is provided with a second window for the reception of nep and undesirable fibers of intermediate mass and one of which is provided with a third window adjacent to the rotary element for the reception of desired fibers; the channels being in fluid communication with an air pressure source; wherein the fast rotary movement results in a centrifugal force, which in combination with the degree of air pressure applied in each of the material-receiving channels causes separation of trash of greater mass than the remaining material as well as the separation of nep and undesirable fibers from good quality fibers.

16 Claims, 2 Drawing Sheets

APPARATUS FOR SORTING FIBERS

The present invention relates to apparatus for sorting fibers and separating them into fractions with desirable and undesirable properties.

As is known, cotton is transported in bale form, the cotton being highly compressed and the bales weighing about 400 to 500 lb.

The steps for transforming this baled cotton into fine cotton yarn are multiple and require different stages of processing in different machines which have been developed over the past two hundred years.

As described in the literature, e.g., in the Manual of Cotton Spinning, the Textile Institute and Butterworth & Co. Ltd. (1965), after the opening of the bale one of the first stages of processing is with a carding machine, wherein carding is defined as the reduction of an entangled mass of fibers to a filmy web by working between two closely spaced, relatively moving surface clothed with sharp points.

As reported in said Manual, baled cotton contains a small percentage of trash, i.e. particles of leaf, seed, coat, and stalk from the cotton plant and also sand and soil from the ground in which the plants were grown, and the preliminary opening gets rid of about 70–80% of this. The remainder is imprisoned in the tufts and some of it is firmly attached to the fibers themselves, and it is a function of the card to remove as much of this as possible. The fine action of the card breaks up the tufts and therefore releases some of the trash for rejection, and the wire surfaces on the carding parts retain a proportion of the residue, so that, after carding, a percentage of the original trash, depending on the type of trash and on the carding action, is left in the sliver.

The earliest implements for carding cotton consisted of two flat pieces of wood, approximately 12 in. long and 4 or 5 in. wide, each provided with a handle and having on each working face teazles or, subsequently, wires angularly mounted in sheets of leather. A quantity of entangled fibers was placed on the working surfaces of one of the cards and repeatedly stroked with the other, with the points of the teazles or wires in opposition, until the material was spread evenly over one of the cards in the form of a thin web in which the fibers were disentangled, to some degree straightened, and substantially aligned by the stroking action.

An early improvement consisted in nailing one of the cards to a bench, and thereby reducing the operative's "work load" to the extent of his having to manipulate one card only. There followed the steps of increasing the size of the fixed card and, ultimately, the suspension of the movable card by two cards, which passed over pulleys and were connected to a balancing weight. The top card was provided with a handle at each end, and it was now possible for the operative gently to bring it down, pass it over the cotton on the lower card, allow the weight to raise the top card, and then repeat the operation. This "stock card", as it was termed, was increased in size, and is known to have been used for the processing of cotton in 1739.

In the next decade, the carding machine was conceived. In 1748, the first carding-machine patents were granted, No. 628 to Daniel Bourn, of Leominster, and No. 636 to Lewis Paul of Birmingham. The drawing of Bourn's machine was attached to his patent speciication and the following was his brief description:

"The properties by which this machine of carding differs from any other method hitherto invented, are principally these—that the cards are put upon cylinders or rollers, and that these act against each other by a circular motion, and that they may be moved either by hand or by a water-wheel. It may be observed that more or fewer may be put in a machine than four cylinder, though that number is found to be most proper. The cards are (helically) wrapped around the cylinders which, by their circular motion, and at the same time their acting upon one another, card the wool or cotton sufficiently fine for spinning."

In 1775 the drawing frame, with its modern accepted function of drafting and doubling, commonly without attenuation, was patented by Arkwright.

Arkwright's basic drawing frame was crude, but it was made more satisfactory as time went on by improvement in engineering practice and by additions to the mechanism as, for example, the invention of the stop motion by James Smith in 1841, and the coiling motion by Tatham and Cheetham, introduced about the same time. After this, the drawframe altered by little for about a hundred years, and it is only recently that marked improvements have appeared.

The introduction of the drawing process enabled spinners to produce finer yarns because of the parallelism of the fibers and also because of the greater regularity resulting from the doubling that occurred at the drawframe. Yet there were still limitations to the finest count that could be spun because the cottons in their carded form contained trashy material, neps, i.e., a small knot of entangled fibers (in the case of cotton, usually comprising dead or immature cotton hairs) and other fiber entanglements, which limited the fineness attainable, and moreover, were regarded as yarn defects. To overcome this detriment, means were sought to rid the cotton yarn of these defects by improvement in the processing.

It was quite common in some mills producing high-quality yarns to have a second carding process after the first one because it was found that double carding led to the elimination of many of the fiber entanglements. Several mechanical combers were invented in the nineteenth century, but the only one to have real success was that invented by Heilmann, his comber being exhibited for the first time at the International Exhibition in 1851. The second successful comber for cotton was that introduced by Nasmith in 1902–3. Nasmith adopted the same fundamental principles of combing as had first been introduced by Heilmann, but he vastly improved the machanism of the machine and, in addition, made it possible to comb staples much shorter than those for which the Heilmann comber was suitable. Such has been the success of the Nasmith comber that the Heilmann became obsolete.

As further explained in the Manual of Cotton Spinning (ibid) Vol. 4, part 2, pages 74–75:

"The short staple length of cotton fibers precludes the use of a continuous method of combing, and all cotton combers operate intermittently; both ends of the fibers are separately combed by needles, and the continuity of the strand is maintained by an ingenious method of piecing-up the separate combed tufts. In brief, the process operates as follows:

(1) A lap of cotton is prepared in which the fibers are arranged as nearly as practicable parallel to each other and to the lengthwise direction of the lap. The lap is fed into the machine between a roller, the feed roller, and a smooth metal plate. At the front end of the plate, a second, vertical, plate is positioned, which operates to grip the lap as it passes along the first plate.

(2) The fibers protruding from the lap beyond the nipping point of the two plates are combed by the passage of rows of needles situated below the lap. The rows of needles are fastened to a cylinder, which revolves and carries away the short fibers, neps and impurities picked up from the fiber fringe. This waste is removed from the combing needles by brushing, and is deposited at the back of the comber.

(3) A second comb, usually having only one row of needles, is inserted in the fiber fringe from above after the first combs have passed the fringe, and the fibers already combed are withdrawn through this top comb by rollers situated in front of the comb. Neps and entanglements pulled forward by the rear ends of the withdrawn fibers are prevented by the comb from passing to the rollers.

(4) After all the combed fibers have been withdrawn from the fringe, the top comb is withdrawn and the bottom comb operates once more, the fringe having been advanced slightly by the feed roller to present a new set of fibers for combing.

(5) The top comb operates again but, before the rollers draw away the newly combed fibers, they turn backwards a little so that the new fibers can be overlapped with those withdrawn in the previous combing, and in this way, the continuity of the combed web of fibers is maintained.

(6) The combed web delivered by the rollers is passed through a trumpet to consolidate the fibers and to make a sliver, which is pulled along a table alongside slivers from other sets of combing mechanisms on the same machine (usually six or eight sets, or "heads"), and the six or eight slivers are drawn into a single sliver by a drafting mechanism at the end of the sliver table and passed into a sliver can."

With this state of the art in mind there is now provided according to the present invention a new apparatus, which can replace the traditional combing machine and which can even be attached to the output of a doffer of a carding machine.

This new apparatus separates a continuous sliver into individual fibers and trash, enabling sorting to be effected by high speed centrifugal action. Trash and poor quality fibers are then removed by vacuum-induced air flows. In a preferred embodiment of the present invention the remaining good quality fibers are then recombined into a sliver by a conveyor moving at a small fraction of the velocity attained by the rotary comber roller.

As is known, the centrifugal force exerted on a body is in proportion to the square of its rotational velocity. The provision of adjustment means in the present invention for the rotational velocity of the rotary comber roller therefore provides an effective means of regulating the sorting action of the apparatus. It is therefore one of the objects of the present invention to provide a sorting apparatus more effective than those known in the prior art.

Thus, according to the present invention there is now provided an apparatus for sorting fibers and separating them into fractions with desirable and undesirable properties comprising a housing provided with a first chamber:

means for introducing fibers to be sorted into said first chamber;

a rotary element revolvably supported in said first chamber and provided with means for receiving said fibers and for applying a fast rotary movement thereto, a multiplicity of material-receiving channels leading from said first chamber, a first of said material-receiving channels being provided with a first window adjacent to said rotary element for the reception of trash of relatively greater mass than the remaining material, a second material-receiving channel being provided with a second window for the reception of nep and undesirable fibers of intermediate mass and a third material receiving channel being provided with a third window adjacent to said rotary element for the reception of desired fibers;

said material-receiving channels being in fluid communication with means for applying varying degrees of air pressure therethrough; wherein said fast rotary movement results in a centrifugal force, which in combination with the degree of air pressure applied in each of said material-receiving channels is sufficient to cause separation of trash of relatively greater mass than the remaining material as well as the separation of nep and undesirable fibers from fibers having desirable properties.

In preferred embodiments of the present invention the exits of the material-receiving channels are in fluid communication with means for applying therein varying below-atmospheric degrees of air pressure. Thus the strongest vacuum or negative pressure is applied to the third channel for drawing out the desired fibers which negative pressure is greater than that applied to the second channel into which the shorter fibers and neps are drawn and which negative pressure in turn is greater than that applied to the first channel into which the trash is drawn.

In especially preferred embodiments of the present invention said means for introducing fibers to be sorted into said first chamber comprises the doffer of a carding machine.

As will be described hereinafter especially with regard to FIG. 3 it is preferred that said doffer and said rotary element be rotated in opposite senses to each other and the apparatus preferably further comprises a guiding surface positioned adjacent the area of engagement between said rotary element and said doffer for redirecting the trajectory of fibers received from said doffer by said rotary element at an angle of less than 80° relative to their original trajectory along the surface of said doffer.

A major advantage of this embodiment is that the rotation of said rotary element in an opposite sense from the rotation of the doffer results in said rotary element contacting the fibers contained on the surface of said doffer at an effective speed which is the combination of the speed of rotation of both said rotary element and said doffer which enhances the separation of the fibers from each other and from components of different mass thereby further facilitating the subsequent separation which is effected.

In preferred embodiments of the invention there are also provided conveying means, positioned at the exit of one of these channels, for collecting and condensing fibers having desirable properties into a silver and for subsequently releasing the newly-formed moving silver composed of such fibers. These conveying means may advantageously comprise the porous surface of a roller provided with an area of reduced air pressure.

In U.S. Pat. No. 4,471,607 relating to an opening unit for open end spinning machines there is shown a special dirt separation duct communicating with a fiber conveying channel.

In U.S. Pat. No. 5,031,280 there is described a method and apparatus for cleaning card slivers pneumatically through spread sliver which includes a generated air flow through a perforted guide surface in order to remove loose contaminations and also dirt and dust particles present in the loose and sliver.

U.S. Pat. No. 5,111,551 relating to compact carding apparatus with sliver thread-up shows a carding a sliver processing apparatus with suction means while U.S. Pat. Nos. 4,129,924 and 3,792,509 provide for the separation of short fibers, nep etc.

None of said patents however teach or suggest the multiseparation apparatus and arrangement of the present invention as described and defined herein.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be emobodied in practice.

Figure 1:
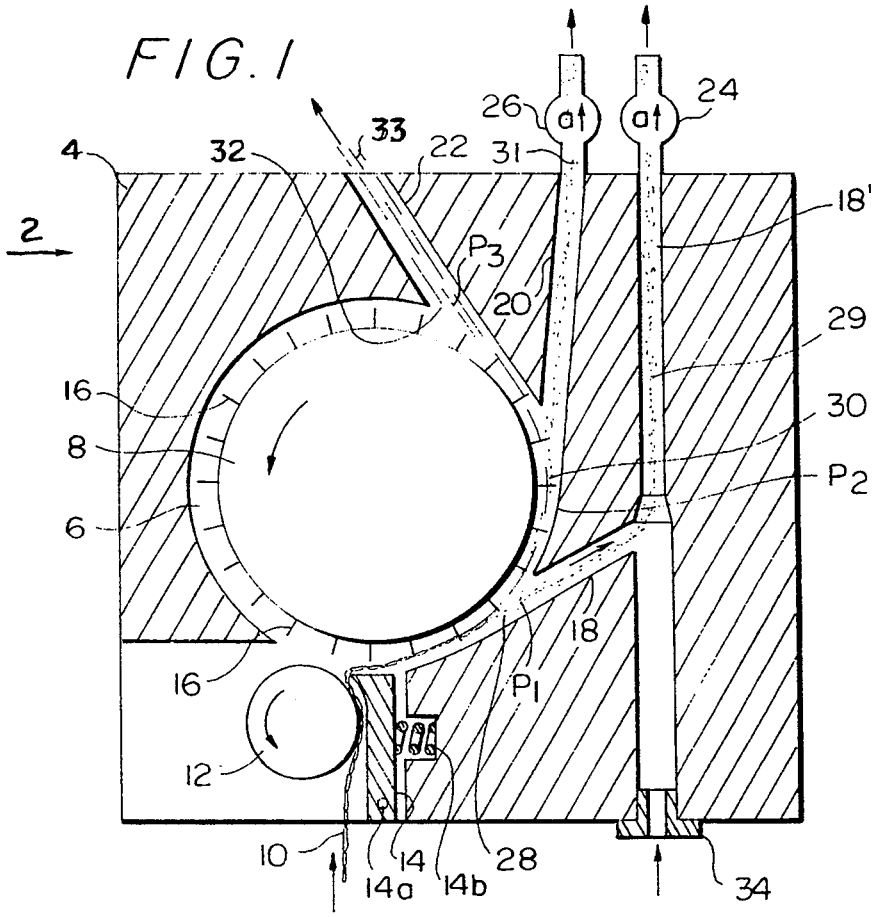
FIG. 1 shows a cross-sectional view of a first embodiment of the separating apparatus according to the present invention.

There is seen in FIG. 1 apparatus 2 for sorting fibers and separating them into fractions with desirable and undesirable properties, comprising a housing 4 provided with a first chamber 6. A rotary element 8 is revolvably supported in the first chamber 6 and is provided with means for receiving a sliver of cotton fibers 10. Means for introducing the fibers 10 into the first chamber 6 are provided in the form of a feed roller 12 and a table 14. The table 14 may advantageously be hinged at 14*a* and urged towards the feed roller 12 by a spring 14*b*.

In the embodiment shown the rotary element 8 is a comber roller provided with a plurality of needles 16 for engaging fibers introduced into the first chamber 6, said comber roller being arranged for applying thereto a fast rotary movement. Preferably the rotary element 8 has a major diameter in the range of 6 to 10 centimeters and is revolved at a speed between 1000 and 10000 revolutions per minute. The resulting centrifugal force is sufficient to cause mutual separation between fibers of different mass, as well as the separation of nep and trash 29 from fibers having desirable properties.

As can be seen the housing 4 is further provided with a plurality of material-receiving channels 18, 20, 22 leading from the first chamber, the channel 18 being connected to an extension channel 18'. Vacuum pump means 24, 26 are in fluid connection with and generate air flow within the material-receiving channels 18, 18' and 20. Negative pressure in channel 18 may be from 0–20 mm $H_2O$, negative pressure in channel 20 may be from 20–50 mm $H_2O$ and negative pressure in channel 22 from 50–300 mm $H_2O$.

The operation of the apparatus 2 is now simple to understand. A sliver of cotton fibers 10 is fed by the feed roller 12 and the table 14 to the rotary element 8 within the first chamber 6. The first material-receiving channel 18 is provided with a first window 28 adjacent to the rotary element for the reception of trash 29 of relatively greater mass than the remaining material, the second material-receiving channel 20 is provided with a second window 30 also adjacent to the rotary element 8 for the reception of nep and undesirable fibers 31 of intermediate mass and the third material-receiving channel 22 is provided with a third window 32 for the reception of desired fibers 33.

By further providing means for varying the velocity of the air flow in at least one of said material-receiving channels, such as the provision of a changeable orifice 34, a balance can be created between the centrifugal and the air flow forces, and it is thereby possible to control the path taken by the various fiber components and impurities. The speed of rotation of the rotary element 8 can also be adjusted, a moderate speed increase causing a sharp increase of the centrifugal force applied to the heavier components of the incoming material, thereby improving separation of trash 29 and increasing the tendency to enter material receiving channel 18. In particular said balance is arranged to ensure that the long desirable fibers 33 enter channel 22.

Figure 2:
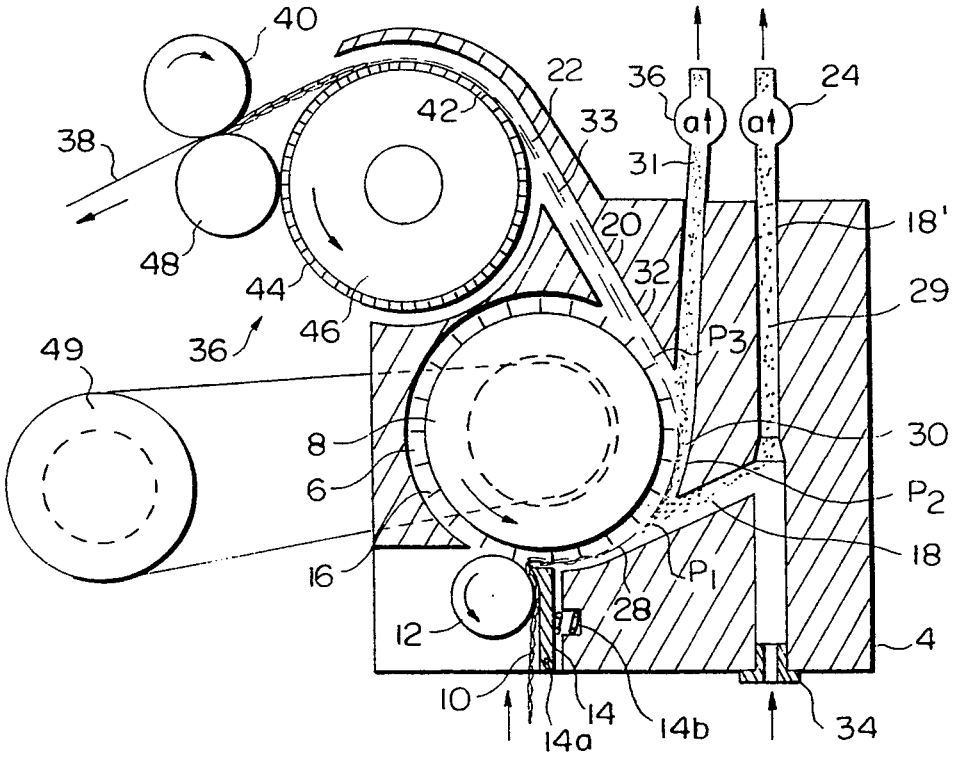
FIG. 2 is a cross-sectional view of a preferred second embodiment showing conveying means for collecting the purified fibers.

Referring now to FIG. 2 there is seen a preferred second embodiment similar to the apparatus 2 described with regard to FIG. 1, but showing also conveying means 36 for collecting the described fibers 33. Like numerals are used to designate like parts. Conveying means 36 are positioned at the exit of the material receiving channel 32 and provided with means for collecting and condensing desired fibers 33 and subsequently releasing a newly-formed moving sliver 38 composed of such fibers. Preferably these collecting and condensing means comprise a surface provided with an area of reduced air pressure 42, which acts to retain fibers on the porous surface 44 of a roller 46. The sliver 38 after passing the area of reduced air pressure 42 is easily separated from the roller 46 and exits between a pair of pinch rollers 40, 48 for compression and consolidation.

Means 49 are provided, such as a variable pitch rubber belt drive, to vary the speed of the rotary element 8.

With reference now to FIG. 3, in which again like numerals are used to designate similar parts, there is seen an especially preferred embodiment of the present invention in which the apparatus of the present invention is attached to and fed by a doffer 50 of a carding machine (not shown).

In this new proposed embodiment there is a major departure from the prior art in that the present apparatus replaces the prior-art combing machines. The sliver of cotton fibers 10 leaving the carding machine can be fed directly to the present apparatus for producing new sliver 38 free of trash and nep.

As will be noted said rotary element 8 and said doffer 50 are rotated in opposite senses to each other and the apparatus further comprises a guiding surface 62 positioned adjacent the area of engagement between said rotary element and said doffer for guiding the trajectory of fibers received from said rotary element at an angle of less than 80° relative to their original trajectory along the surface of said doffer.

Figure 3:
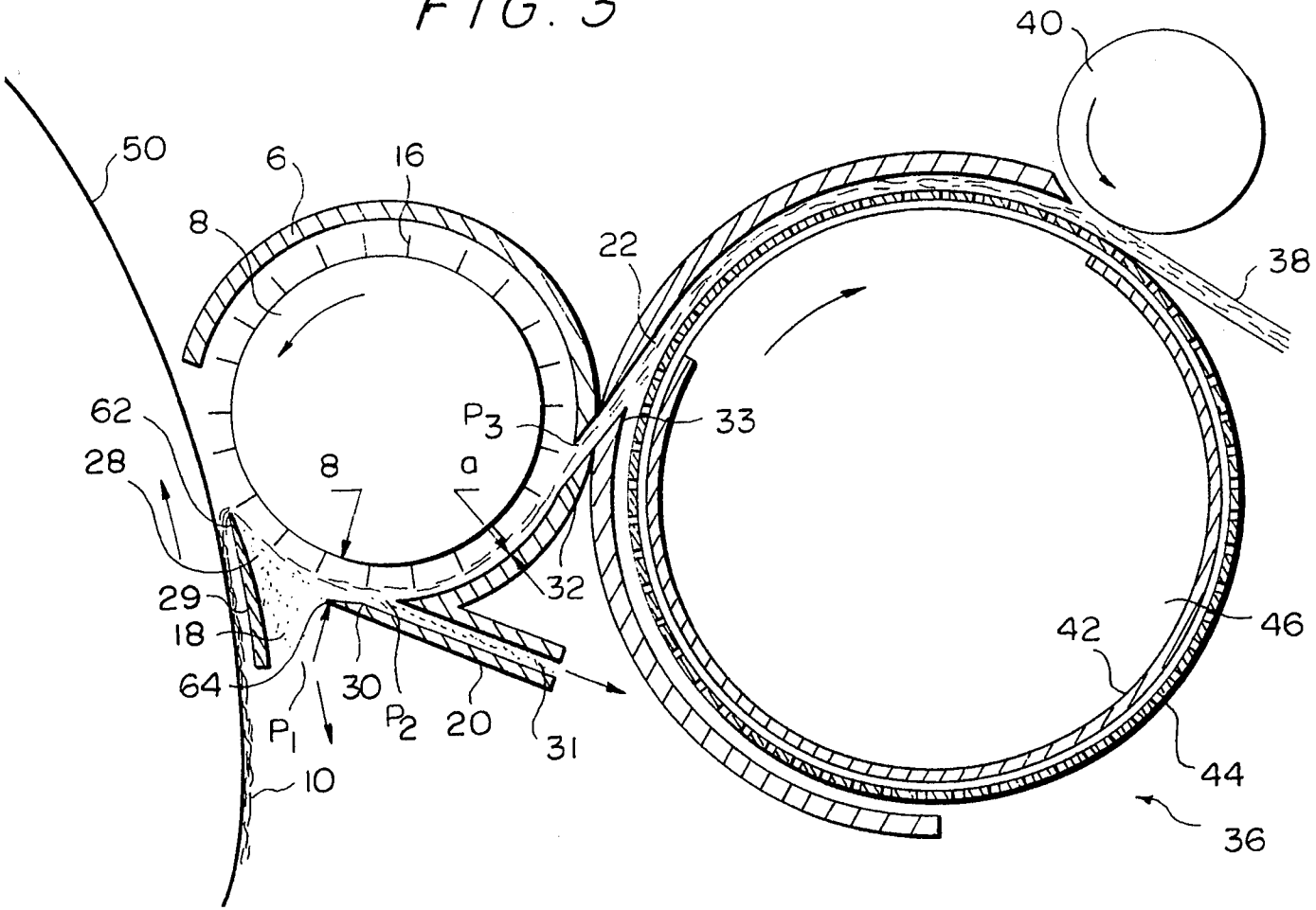
FIG. 3 shows a third embodiment wherein a flow-director element is provided and the doffer of a card machine serves as input means.

FIG. 3 also shows material-receiving channels 18, 20 and 22 wherein negative pressure $P_1$ applied to channel 18 is preferably from 0–20 mm $H_2O$ while negative pressure $P_2$ applied to channel 20 is preferably from 20–50 mm $H_2O$ and negative pressure $P_3$ applied to channel 22 is preferably from 50–300 mm $H_2O$.

Also in this preferred embodiment of the invention the distance B between the ends of the needles 16 of rotary element 8 and the guiding surface 64 of second window 30 is greater than the distance A between the ends of needles 16 and the wall of chamber 6. Thus, the distance A between the ends of needles 16 and the walls of housing 6 is approximately 1 mm while the distance B is approximately 2–5 mm thereby facilitating the separation of short fibers and neps into the channel 20 because of their weaker link with the needles. On the other hand, the longer fibers are more tightly held by said needles and proceed with the roller to channel 22.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. An apparatus for sorting fibers and separating them into fractions with desirable and undesirable properties comprising a housing provided with a first chamber:

means for introducing fibers to be sorted into said first chamber;

a rotary element revolvably supported in said first chamber and provided with means for receiving said fibers and for applying a fast rotary movement thereto, a multiplicity of material-receiving channels leading from said first chamber, a first of said material-receiving channels being provided with a first window adjacent to said rotary element for the reception of trash of relatively greater mass than the remaining material, a second material-receiving channel being provided with a second window for the reception of nep and undesirable fibers of intermediate mass and a third material receiving channel being provided with a third window adjacent to said rotary element for the reception of desired fibers;

said material-receiving channels being in fluid communication with means for applying varying degrees of air pressure therethrough;

wherein said fast rotary movement results in a centrifugal force, which in combination with the degree of air pressure applied in each of said material-receiving channels is sufficient to cause separation of trash of relatively greater mass than the remaining material as well as the separation of nep and undesirable fibers from fibers having desirable properties.

2. The apparatus according to claim 1 wherein said means for introducing fibers to be sorted into said first chamber comprises the doffer of a carding machine.

3. The apparatus according to claim 2 wherein said doffer and said rotary element are rotated adjacent to each other, forming an area of engagement therebetween.

4. The apparatus according to claim 3 further comprising a guiding surface positioned adjacent the area of engagement between said rotary element and said doffer for guiding the trajectory of fibers received from said doffer at an angle of less than 80° relative to their original trajectory along the surface of said doffer.

5. The apparatus according to claim 1, further provided with conveying means positioned at the exit of one of said channels and provided with means for collecting and condensing fibers having desirable properties and subsequently releasing a newly formed moving silver of such fibers.

6. The apparatus according to claim 2 wherein said collecting and condensing means comprise a surface provided with an area of reduced air pressure.

7. The apparatus according to claim 3 wherein said surface is a porous surface of a roller.

8. The apparatus according to claim 1 wherein said rotary element comprises a comber roller provided with a plurality of needles for engaging fibers introduced into said first chamber.

9. The apparatus according to claim 1 wherein said rotary element has a major diameter in the range of 6 to 10 centimeters and is revolved at a speed between 1000 and 10,000 revolutions per minute.

10. The apparatus according to claim 1 further provided with means to vary the speed of said rotary element.

11. The apparatus according to claim 1 wherein the exits of said material-receiving channels are in communication with means for applying below-atmospheric air pressure.

12. The apparatus according to claim 1 further provided with a means for varying the velocity of said air flow in at least on of said material-receiving channels.

13. The apparatus according to claim 11 wherein the negative pressure in said third material-receiving channel is greater than in the second channel and the negative pressure in the second channel is greater than in said first channel.

14. The apparatus according to claim 1 wherein said rotary element is provided with a plurality of pick-up needles for engaging fibers introduced into said first chamber and said second window is further provided with a guiding surface leading to said second channel and the distance between the ends of said needles and the wall of said chamber is less than the distance between the ends of said needles and said guiding surface.

15. An apparatus for sorting fibers and separating them into fractions with desirable and undesirable properties comprising a housing provided with a first chamber:

introducing means for introducing fibers to be sorted into said first chamber, said introducing means comprising a carding machine doffer;

a rotary element revolvably supported in said first chamber and provided with means for receiving said fibers and for applying a fast rotary movement thereto, in an area of engagement with said doffer;

a guiding surface positioned adjacent the area of engagement between said rotary element and said doffer for guiding the trajectory of fibers received from said doffer at an angle of less than 80° relative to their original trajectory along the surface of said doffer;

a multiplicity of material-receiving channels leading from said first chamber, a first of said material-receiving channels being provided with a first window adjacent to said rotary element for the reception of trash of relatively greater mass than the remaining material, a second material-receiving channel being provided with a second window for the reception of nep and undesirable fibers of intermediate mass and a third material receiving channel being provided with a third window adjacent to said rotary element for the reception of desired fibers;

said materials-receiving channels being in fluid communication with means for applying varying degrees of air pressure therethrough;

wherein said fast rotary movement results in a centrifugal force, which in combination with the degree of air pressure applied in each of said material-receiving channels is sufficient to cause separation of trash of relatively greater mass than the remaining material as well as the separation of nep and undesirable fibers from fibers having desirable properties.

16. An apparatus for sorting fibers and separating them into fractions with desirable and undesirable properties comprising a housing provided with a first chamber;

means for introducing fibers to be sorted into said first chamber; and separation means for separating trash of relatively greater mass than remaining material and for the separation of nep and undesirable short fibers of intermediate mass from fibers having desirable properties, said separation means comprising a rotary element revolvably supported in said first chamber and provided with means for receiving said fibers and for applying a fast rotary movement thereto, a multiplicity of material-receiving channels leading from said first chamber, a first of said material-receiving channels being provided with a first window adjacent to said rotary element for the reception of trash of relatively greater mass than the remaining material, a second material-receiving channel being provided with a second window for the reception of nep and undesirable short fibers of intermediate mass and a third material receiving channel being provided with a third window adjacent to said rotary element for the reception of desired fibers, and means for applying varying degrees of air pressure through said material-receiving channels.

* * * * *